US006572395B1

(12) United States Patent
Burlew et al.

(10) Patent No.: US 6,572,395 B1
(45) Date of Patent: Jun. 3, 2003

(54) AIR EXPANSION COMPENSATOR

(75) Inventors: Robert A. Burlew, Byron, MI (US); William R. Tabor, Livonia, MI (US); Harry Zaverzence, Macomb Township, MI (US)

(73) Assignee: Electrical Wiring Component Applications Partnership, Southfield, MI (US)

( * ) Notice: Subject to any disclaimer, the term of this patent is extended or adjusted under 35 U.S.C. 154(b) by 0 days.

(21) Appl. No.: 09/343,850

(22) Filed: Jun. 30, 1999

(51) Int. Cl.[7] ..... H01R 4/60; H01R 4/64
(52) U.S. Cl. ..... 439/198; 439/206
(58) Field of Search ..... 439/198, 205, 439/206, 201

(56) References Cited

U.S. PATENT DOCUMENTS

| | | | | | |
|---|---|---|---|---|---|
| 1,227,404 | A | | 5/1917 | Du Bois | |
| 3,717,078 | A | * | 2/1973 | Ogura | 95/11 |
| 4,050,765 | A | * | 9/1977 | Duesterhoeft et al. | 439/205 |
| 4,071,040 | A | | 1/1978 | Moriarty | 137/199 |
| 4,311,355 | A | * | 1/1982 | Plyler et al. | 439/274 |
| 4,331,830 | A | | 5/1982 | Conway et al. | 174/16 R |
| 4,691,083 | A | | 9/1987 | Dienes | 174/11 R |
| 4,722,696 | A | * | 2/1988 | Ballhause | 439/275 |
| 4,828,507 | A | * | 5/1989 | Nagase et al. | 439/206 |
| 4,853,722 | A | * | 8/1989 | Gell, Jr. | 354/64 |
| 4,923,405 | A | | 5/1990 | Munsterman et al. | 439/78 |
| 5,159,366 | A | * | 10/1992 | Gell, Jr. | 354/64 |
| 5,394,208 | A | * | 2/1995 | Cambell | 354/64 |
| 5,399,855 | A | * | 3/1995 | Rouleau et al. | 250/239 |
| 5,588,856 | A | | 12/1996 | Collins et al. | 439/204 |
| 5,685,729 | A | * | 11/1997 | Reider et al. | 439/206 |
| 5,870,632 | A | * | 2/1999 | Ho | 396/26 |

FOREIGN PATENT DOCUMENTS

| | | | |
|---|---|---|---|
| DE | 1816673 | * | 7/1969 |

* cited by examiner

*Primary Examiner*—Neil Abrams
(74) *Attorney, Agent, or Firm*—Mark P. Calcaterra

(57) ABSTRACT

The present invention provides a flexible air expansion compensator including an air chamber. The air expansion compensator mates with a terminal cavity of a sealed electrical connector to compensate for heating and cooling of air trapped in a device that contains the sealed electrical connector.

9 Claims, 2 Drawing Sheets

AIR EXPANSION COMPENSATOR

BACKGROUND OF THE INVENTION

1. Technical Field

The present invention relates generally to a flexible air expansion compensator, and more particularly to a device with a sealed electrical connector that employs an air expansion compensator.

2. Discussion

Certain devices in vehicles, such as oil pressure sensors or oxygen sensors with sealed electrical connectors, may experience a rapid air expansion as a result of an increase in temperature from mechanical components. These unequalled pressure changes cause air and moisture to travel through the wires or terminals of the sensor and can adversely affect the calibration of the sensor. Thus a device is needed that compensates for an increase or decrease of air pressure in a sensor during fluctuations in temperature, thereby eliminating moisture.

The present invention provides an air expansion compensator device that compensates for the air expansion in a sensor without compromising the sealing effectiveness of the electrical connector.

SUMMARY OF THE INVENTION

The present invention provides a flexible air expansion compensator including an air chamber. The air expansion compensator mates with a terminal cavity of a sealed electrical connector to compensate for the heating and cooling of air trapped in a device that contains the sealed electrical connector.

The present invention further provides a device having a sealed electrical connector with a plurality of terminal cavities. The device comprises an air expansion compensator that mates with one of the terminal cavities of the electrical connector.

BRIEF DESCRIPTION OF THE DRAWINGS

Additional advantages and features of the present invention will become apparent from the subsequent description and the appended claims taken in conjunction with the accompanying drawings.

DETAILED DESCRIPTION OF THE PREFERRED EMBODIMENT

The air expansion compensator of the present invention may be employed with various devices, such as sensors with sealed electrical connectors. The compensator preferably is employed with sensors that are sensitive to moisture and directly mounted to the engine block of a motor vehicle. Because the mechanical components of the sensor are heated, the temperature inside the sensor fluctuates, allowing air to expand and contract. The air then flows up and down the terminals of the device, affecting the calibration of the sensor device. The present invention provides an air expansion compensator having a hollow air chamber that expands and contracts with the heating and cooling of air that is trapped in the sensor and electrical connector cavities.

Figure 1:
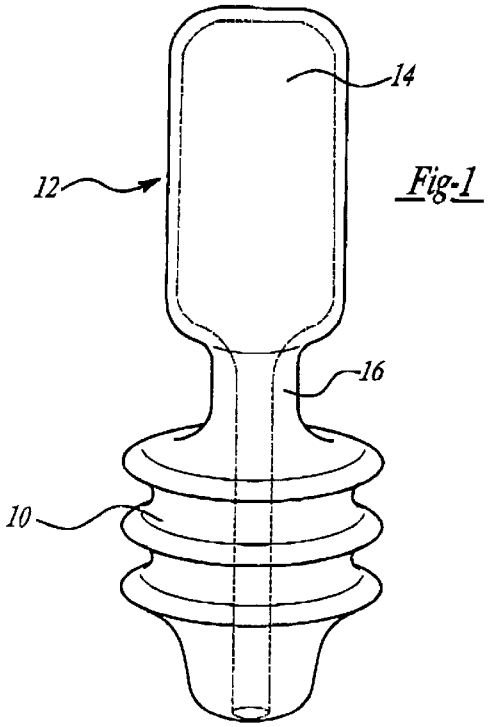
FIG. 1 is an air expansion compensator of the present invention shown mated with a cable seal.
Figure 2:
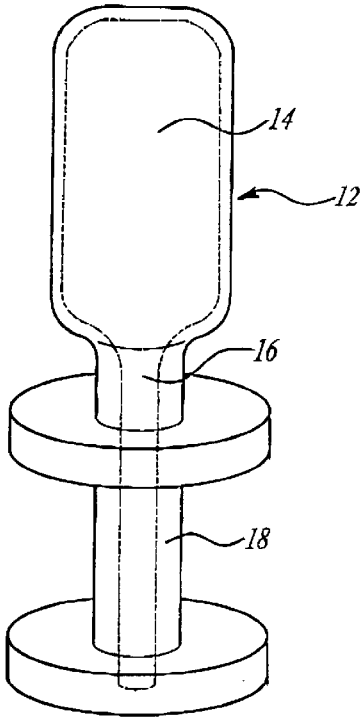
FIG. 2 is an air expansion compensator of the present invention shown mated with a matte seal.

Referring now to FIG. 1, a cable seal 10 is shown with the present invention air expansion compensator 12. Compensator 12 includes a hollow body portion or air chamber 14 and a connector portion 16 for mating with a terminal cavity of a sealed electrical connector. Compensator 12 is preferably of a dimensional length that will maintain the calibration of the sensor device within its design limits. In one embodiment, the compensator is about 20 millimeters in length and about 7 millimeters in diameter. In a preferred embodiment, terminal cavities of an electrical connector are sealed to prevent moisture from tracking between the terminals. The electrical connector system may be sealed by a cable seal, such as cable seal 10. Alternatively, as shown in FIG. 2, a matte seal 18 may be used to seal terminal cavities of an electrical connector.

Figure 3:
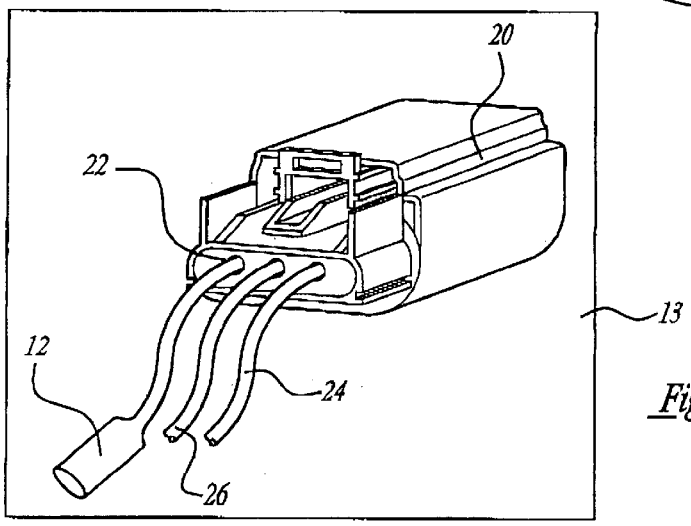
FIG. 3 is a sealed electrical connector shown mated with an air expansion compensator.

Referring now to FIG. 3, an electrical connector 20 is shown. Air expansion compensator 12 mates with or plugs into one of a plurality of terminal cavities 22 that holds a terminal wire, such as wires 24 and 26 as indicated in FIG. 3. Thus, in a preferred embodiment, compensator 12 protrudes from electrical connector 20 in a similar fashion to a typical terminal wire. Because the air expansion compensator mates with or plugs into a matte or cable seal located inside the electrical connector, the sealing integrity of the connector is maintained also.

Figure 4:
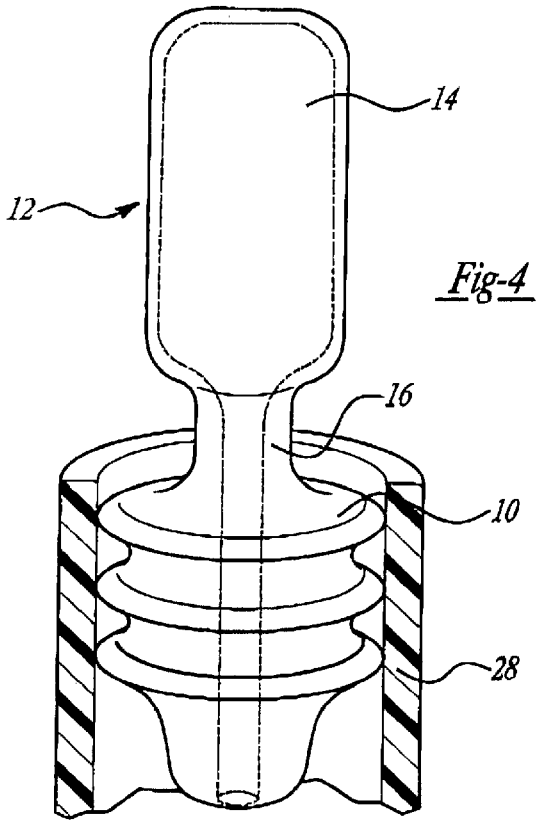
FIG. 4 is a cross-section view of a cable seal in an electrical connector with an air expansion compensator.
Figure 5:
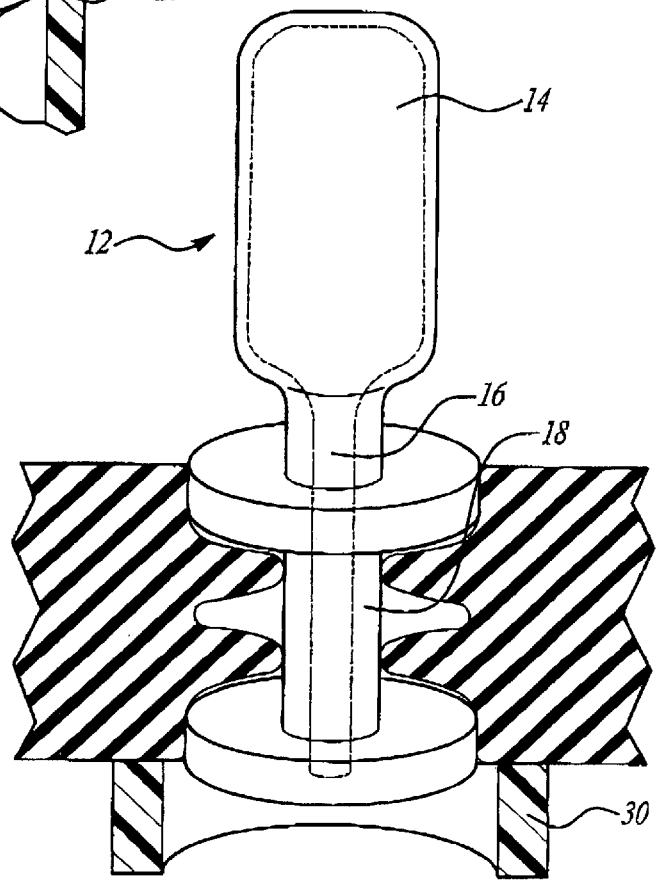
FIG. 5 is a cross-section view of a matte seal in an electrical connector with an air expansion compensator.

Electrical connector 20 includes a housing 28, as shown in FIG. 4, which encompasses cable seal 10. Similarly, housing 30 of the electrical connector may include matte seal 18, as shown in FIG. 5. The connector housing may be any rigid material, such as, for example, plastic. The air expansion compensator may be made of any flexible material, preferably, but not limited to, silicone rubber, synthetic rubber and polyethylene. The matte and cable seals are also preferably comprised of a flexible material, such as silicone rubber.

While the above detailed description describes the preferred embodiment of the present invention, the invention is susceptible to modification, variation, and alteration without deviating from the scope and fair meaning of the subjoined claims.

What is claimed is:

1. An air expansion compensator for use with a sealed electrical connector having a connector housing including a plurality of terminal cavities normally used for sealed receipt of electrical conductors entering the housing, the air expansion compensator comprising:

an expandable chamber that varies in volume to compensate for fluid pressure variations in the housing of the sealed electrical connector;

a connector portion adapted to fluidly couple the expandable chamber to one of the plurality of terminal cavities; and a seal coupled to the connector portion so as to be adapted to sealingly couple the connector portion to the one terminal cavity, whereby the expandable chamber is adapted to be coupled in sealed fluid communication with the housing in a manner similar to that in which electrical conductors are coupled to the housing.

2. The air expansion compensator of claim 1, wherein said seal includes a matte seal.

3. The air expansion compensator of claim 1, wherein said seal includes a cable seal.

4. The air expansion compensator of claim 1, wherein said connector portion is generally tubular.

5. A sealed electrical connector for use in coupling an electrical device to at least one conductor, the sealed electrical connector comprising:

a connector housing including at least two terminal cavities normally used for receipt of conductors entering the housing;

a first terminal cavity adapted to be in sealed electrical communication with the at least one conductor; and an air expansion compensator in sealed fluid communication with a second terminal cavity, whereby the compensator is coupled to the housing in a manner similar to that of the at least one conductor, the compensator varying in volume to compensate for fluid pressure variations within the connector housing.

6. The sealed electrical connector of claim 5, wherein said air expansion compensator includes:

a chamber;

a port having a first end in fluid communication with said chamber;

a seal disposed at a second end of said port for sealing said air expansion compensator within said second terminal cavity; and wherein said second end is receivable into said second terminal cavity of said sealed electrical connector such that said air expansion compensator compensates for expansion of air through the sealed electrical connector.

7. The air expansion compensator of claim 6, wherein said seal includes a matte seal.

8. The air expansion compensator of claim 6, wherein said seal includes a cable seal.

9. The air expansion compensator of claim 6, wherein said port is generally tubular.

* * * * *